US010039389B2

(12) United States Patent
Yang

(10) Patent No.: US 10,039,389 B2
(45) Date of Patent: Aug. 7, 2018

(54) CRIB

(71) Applicant: Xiamen Baby Pretty Products Co., Ltd., Xiamen (CN)

(72) Inventor: Jianbo Yang, Xiamen (CN)

(73) Assignee: Xiamen Baby Pretty Products Co., Ltd., Xiamen (CN)

( * ) Notice: Subject to any disclaimer, the term of this patent is extended or adjusted under 35 U.S.C. 154(b) by 0 days.

(21) Appl. No.: 15/823,605

(22) Filed: Nov. 28, 2017

(65) Prior Publication Data

US 2018/0192784 A1 Jul. 12, 2018

(30) Foreign Application Priority Data

Jan. 6, 2017 (CN) ..... 2017 2 0014044 U

(51) Int. Cl.
*A47D 9/02* (2006.01)
*A47D 7/01* (2006.01)
*A47C 19/04* (2006.01)

(52) U.S. Cl.
CPC ..... *A47D 7/01* (2013.01); *A47D 9/02* (2013.01); *A47C 19/045* (2013.01)

(58) Field of Classification Search
CPC ..... A47D 9/02; A47D 7/00
USPC ..... 5/105, 93.1, 93.2, 101–102
See application file for complete search history.

(56) References Cited

U.S. PATENT DOCUMENTS 744,993 A * 11/1903 Barta ..... A47D 9/02 5/105

FOREIGN PATENT DOCUMENTS

| | | | |
|---|---|---|---|
| CA | 23356043 | A1 | 5/2002 |
| CN | 201253038 | Y | 6/2009 |
| CN | 104129417 | A | 11/2014 |
| CN | 104176105 | A | 12/2014 |
| CN | 104414033 | A | 3/2015 |
| DE | 7013606 | U | 9/1970 |
| DE | 7025143 | U | 11/1970 |
| DE | 7206097 | U | 5/1972 |
| DE | 7243919 | U | 3/1973 |
| DE | 2313682 | A1 | 10/1973 |
| DE | 7502595 | U | 10/1976 |
| DE | 3307221 | U1 | 5/1983 |
| DE | 1985147 | U | 5/1986 |
| DE | 3901594 | U1 | 4/1989 |
| DE | 3115973 | U1 | 2/1992 |
| DE | 29801610 | U1 | 5/1998 |
| DE | 29816086 | U1 | 12/1998 |
| DE | 20209048 | U1 | 9/2002 |
| DE | 202010014023 | U1 | 12/2010 |

(Continued)

*Primary Examiner* — Fredrick C Conley
(74) *Attorney, Agent, or Firm* — Gokalp Bayramoglu

(57) ABSTRACT

The present invention provides a crib. The crib comprises an enclosing element configured for holding a baby therein, a frame assembly configured for supporting the enclosing element, a bracket assembly connected to the frame assembly and configured for supporting the frame assembly, and at least two foldable plates pivotably connected to the bracket assembly such that each foldable plate can rotate between an unfolded position and a folded position. Each foldable plate has a curved surface, the curved surfaces of the at least two foldable plates contact the ground to enable the crib to swing when the at least two foldable plates are in their unfolded position. The present invention also provides a crib frame.

18 Claims, 13 Drawing Sheets

(56) References Cited

FOREIGN PATENT DOCUMENTS

| | | | |
|---|---|---|---|
| EP | 1374769 | A1 | 1/2004 |
| EP | 1417983 | A2 | 5/2004 |
| EP | 1457217 | A1 | 9/2004 |
| EP | 1462334 | A2 | 9/2004 |
| EP | 1519172 | A1 | 3/2005 |
| EP | 1530935 | A1 | 5/2005 |
| EP | 1591307 | A2 | 11/2005 |
| EP | 1591341 | A2 | 11/2005 |
| EP | 1444910 | B1 | 5/2006 |
| EP | 1317896 | B1 | 8/2007 |
| EP | 1818060 | A1 | 8/2007 |
| EP | 1897464 | A1 | 3/2008 |
| EP | 1616747 | A3 | 12/2008 |
| EP | 1621395 | B1 | 9/2010 |

* cited by examiner

CRIB

CROSS REFERENCE TO RELATED APPLICATIONS

This application is based upon and claims priority to Chinese Patent Application No. 201720014044.9, filed on Jan. 6, 2017, the entire contents of which are incorporated herein by reference.

TECHNICAL FIELD

The present invention relates to the technical field of baby products, more particularly to a multi-functional crib.

BACKGROUND

Crib is a bed used for infants and young children. In order to ensure the safety of the sleeping baby, the existing cribs cannot act as a cradle. Without the rhythm of rocking, the baby may cry and cannot fall asleep easily. The Chinese Patent Application No. CN201210289214.6 discloses a crib, the bottom of which can be either linear or arc-shaped so as to function as a stationary-type crib or a cradle-style crib, respectively. However, this crib cannot realize smooth and convenient switch between its two states.

SUMMARY

The object of this invention is to provide a crib, which can be easily switched between the cradle-type and the stationary-type.

According to one aspect, the present invention provides a crib. The crib comprises an enclosing element configured for holding a baby therein, a frame assembly configured for supporting the enclosing element, a bracket assembly connected to the frame assembly and configured for supporting the frame assembly, and at least two foldable plates pivotably connected to the bracket assembly such that each foldable plate can rotate between an unfolded position and a folded position. Each foldable plate has a curved surface, the curved surfaces of the at least two foldable plates contact the ground to enable the crib to swing when the at least two foldable plates are in their unfolded position.

Furthermore, the bracket assembly includes a first bracket and a second bracket, each of the first bracket and the second bracket includes an upper section and a lower section telescopically connected to the upper section, the lower section has an inverted T-shaped structure and includes an upright bar and a horizontal bar, the at least two foldable plates are pivotably connected to the horizontal bars.

Furthermore, each horizontal bar includes two first mounting bases, and each foldable plate includes two second mounting bases each corresponding to one of the first mounting bases. Each first mounting base has a first shaft hole. Each second mounting base has a second shaft hole.

Furthermore, the foldable plate is pivotably connected to the horizontal bar through one shaft passing through the two first shaft holes and the two second shaft holes or through two shafts each passing through one pair of the first shaft hole and the second shaft hole.

Furthermore, each first mounting base has a plurality of locating holes disposed in a first circle with the first shaft hole as the center of the first circle. Each second mounting base has a plurality of locating bump disposed in a second circle with the second shaft hole as the center of the second circle. Each locating bump is adapted to be received in each locating hole such that multiple intermediate positions can be provided between the unfolded position and the folded position. The number of the plurality of locating holes is no less than the number of the plurality of locating bumps.

Furthermore, the number of the plurality of locating bumps are four, and the number of the plurality of locating holes are six.

Furthermore, the enclosing element includes four side walls and a bottom portion, and at least one of the side wall is provided with an opening for observing the baby.

Furthermore, the frame assembly includes an upper frame for supporting top edges of the side walls of the enclosing element and a lower frame for supporting the bottom of the enclosing element.

Furthermore, both the upper frame and the lower frame are connected to the upper section of the bracket assembly.

Furthermore, both, the upper section and the lower section of the bracket assembly are provided with one or more locking holes through which the upper section and the lower section can be fixed relative to each other.

Furthermore, the crib further comprises a pull-rod controlling mechanism. The pull-rod controlling mechanism includes a controlling switch attached to the upper section of the bracket assembly, a pin assembly disposed on the bracket assembly, and a pull-rod connected between the controlling switch and the pin assembly.

Furthermore, the pin assembly includes a housing, a weight block slidable in the housing, a pin having an inserting part extending beyond the housing, and a spring is provided between the weight block and the housing to provide a biasing force against the weight block. The pin is provided with a first hinging hole and a second hinging hole. The second hinging hole has an elongate structure with two curved ends. The pin is hinged to the housing through first hinging hole and is hinged to the weight block through the second hinging hole such that when the weight block moves downward under the force of gravity and the biasing force. The pin rotates about the first hinging hole counterclockwise to insert the inserting part into two aligned locking holes, the upper bracket and the lower bracket to lock the upper bracket and the lower bracket with each other.

Furthermore, each end of each horizontal bar is provided with a wheel.

Furthermore, the foldable plate is shaped and sized such that when the foldable plate is fully unfolded, all the wheels and the curved surfaces contact the ground.

According to another aspect, the present invention provides a crib frame. The crib frame comprises a frame assembly, a bracket assembly connected to the frame assembly and configured for supporting the frame assembly and at least two foldable plates pivotably connected to the bracket assembly such that each foldable plate can rotate between an unfolded position and a folded position. Each foldable plate has a curved surface, the curved surfaces of the at least two foldable plates contact the ground to enable the crib to swing when the at least two foldable plates are in their unfolded position.

Furthermore, the bracket assembly includes a first bracket and a second bracket, each of the first bracket and the second bracket includes an upper section and a lower section telescopically connected to the upper section, the lower section has an inverted T-shaped structure and includes an upright bar and a horizontal bar, the at least two foldable plates are pivotably connected to the horizontal bars.

Furthermore, each horizontal bar includes two first mounting bases, and each foldable plate includes two second mounting bases each corresponding to one of the first mounting bases. Each first mounting base has a first shaft hole. Each second mounting base has a second shaft hole.

Furthermore, the foldable plate is pivotably connected to the horizontal bar through one shaft passing through the two first shaft holes and the two second shaft holes or through two shafts each passing through one pair of the first shaft hole and the second shaft hole.

Furthermore, each first mounting base has a plurality of locating holes disposed in a first circle with the first shaft hole as the center of the first circle. Each second mounting base has a plurality of locating bump disposed in a second circle with the second shaft hole as the center of the second circle. Each locating bump is adapted to be received in each locating hole such that multiple intermediate positions can be provided between the unfolded position and the folded position. The number of the plurality of locating holes is no less than the number of the plurality of locating bumps.

Furthermore, the number of the plurality of locating bumps are four, and the number of the plurality of locating holes are six.

The present invention has the following beneficial effects. First, the height of the crib is adjustable according to user's requirement. Second, an opening is provided on a side of the crib such that the crib surface can be aligned with a bed surface when they are put together. Third, the crib body can easily be folded and carried.

DETAILED DESCRIPTION OF THE EMBODIMENTS

The above and other objects, features, advantages and technical and industrial significance of this invention will be better understood with the help of the following detailed description of preferred embodiments of the invention and the accompanying drawings. Elements in the FIGURES are illustrated for simplicity and clarity and have not necessarily been drawn to scale.

Figure 1:
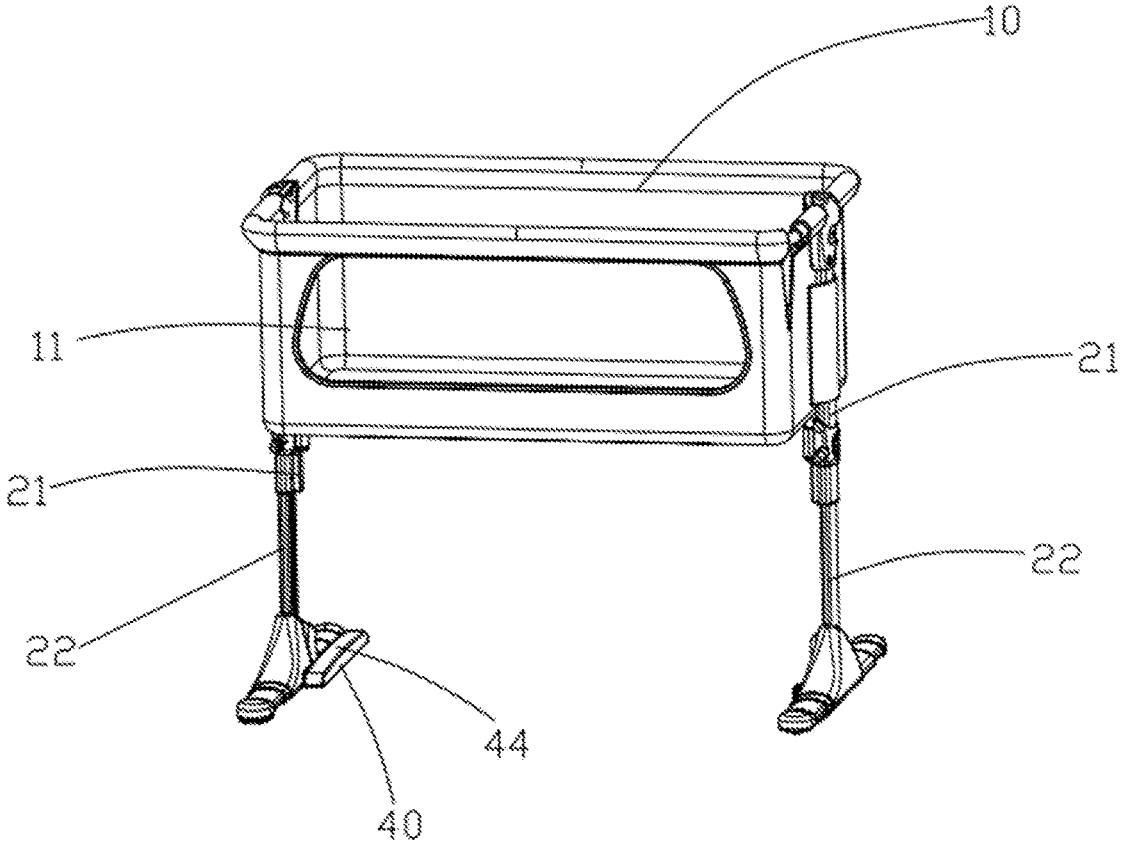
FIG. 1 is a schematic view of a crib according to the present invention.

FIG. 1 is a schematic view of a crib according to the present invention. As shown in FIG. 1, the crib comprises the enclosing element 10, a frame assembly for holding the enclosing element 10, the bracket assembly 21 for supporting the frame assembly, the foldable plate 40 pivotably connected to the bracket assembly 21 and having a curved surface 44. The enclosing element 10 is attached to the frame assembly and is configured to receive a baby. In some embodiments, the enclosing element 10 is made of a textile material and includes four side walls and a bottom wall. In some embodiments, the enclosed element 10 includes an observing opening in its front wall. In some embodiments, the observing opening is covered with a transparent cover.

Figure 2:
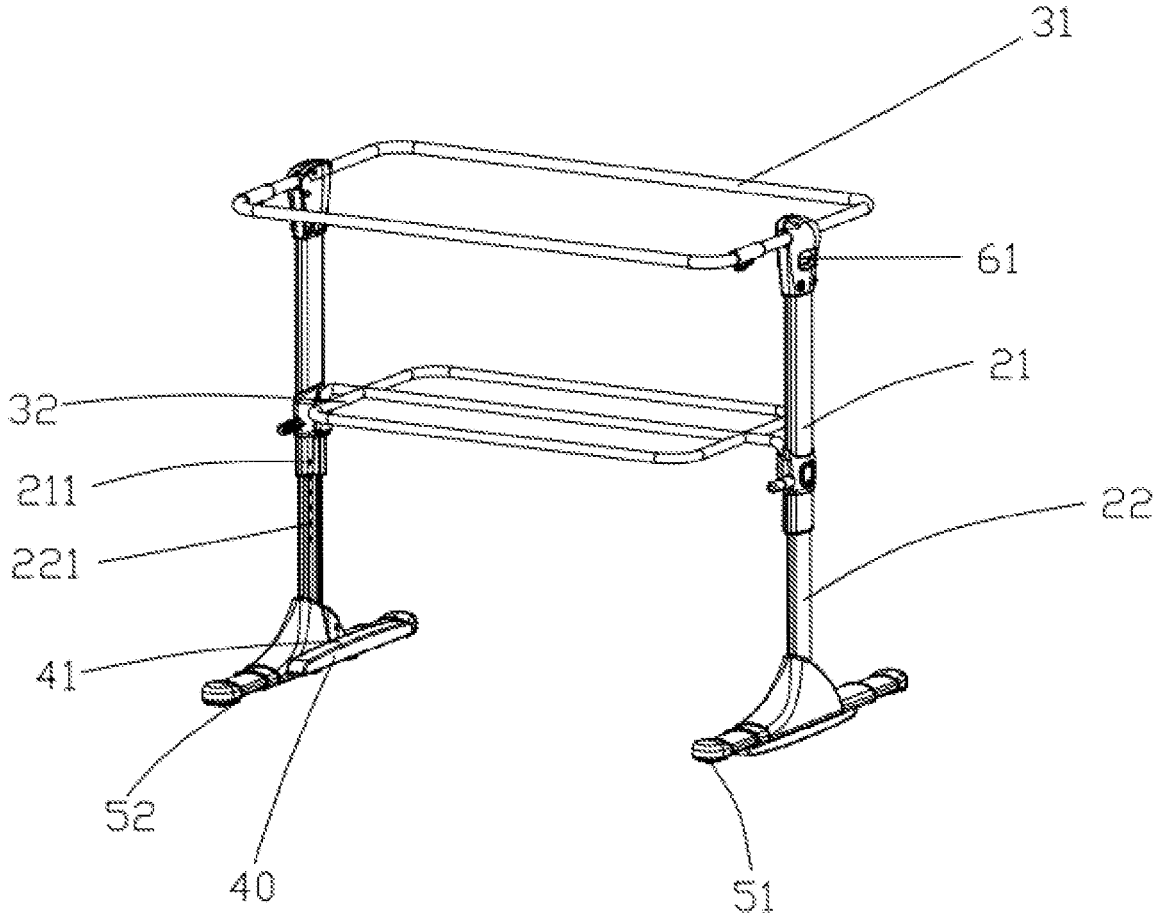
FIG. 2 is a schematic view of the crib according to the present invention where the enclosing element is removed.

FIG. 2 is a schematic view of the crib according to the present invention where the enclosing element is removed. As shown in FIG. 2, the frame assembly includes the upper frame 31 and the lower frame 32. The upper frame 31 is attached to the top edge of the side walls of the enclosing element for supporting the enclosing element. The lower frame 32 is used to support the bottom of the enclosing element. The upper frame 31 is detachably mounted on the bracket assembly 21. In this embodiment, the bracket assembly includes two brackets, one on the left side, and one on the right side. Each of the two brackets includes the upper section 21 and the lower section 22. The upper section 21 has a rod-shaped structure. In this embodiment, both the upper frame 31 and the lower frame 32 are snapped into the upper section 21. Those skilled in the art should know that, the upper frame 31 and the lower frame 32 can be mounted on the bracket assembly through other connections, such as screw connection, clamping connection. The lower section 22 has an inverted T-shape structure. The upper section 21 is provided with at least one locating hole 211, and the lower section 22 is provided with at least one locating hole 221. In the present embodiment, one locating hole 211 and more than one locating hole 221 are provided. The upper portion of the upright portion of the inverted T-shape lower section 22 is telescopically connected to the upper section 21. A pull-rod mechanism, which will be described hereafter, is used to lock the upper section 21 relative to the lower section 22 after the locating hole 211 is aligned with the locating hole 221.

Figure 3:
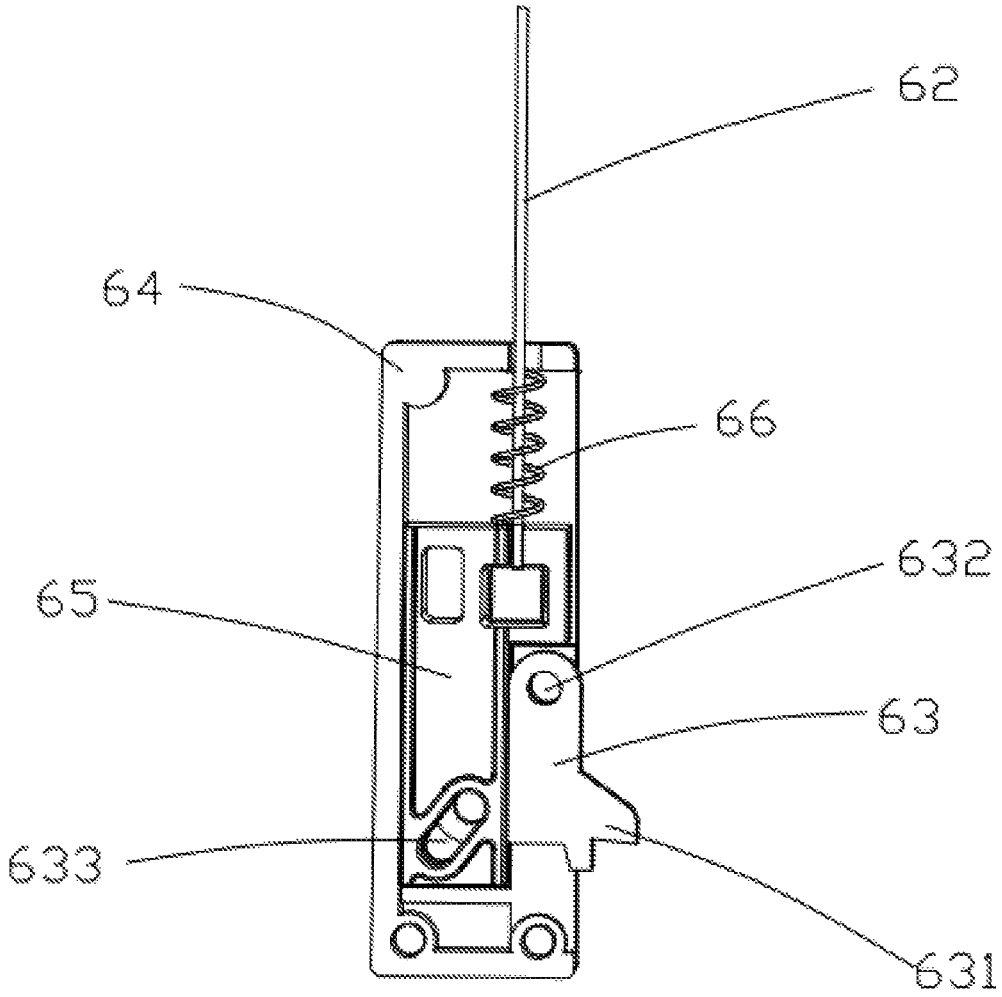
FIG. 3 is a partial schematic view of the pull-rod controlling mechanism.

FIG. 3 is a partial schematic view of the pull-rod controlling mechanism. As shown in FIG. 2 to FIG. 3, the pull-rod controlling mechanism includes the controlling switch 61 attached to the upper section 21 of the bracket assembly, a pin assembly disposed on the upper section 21 of the bracket assembly, the pull-rod 62 connected between the controlling switch 61 and the pin assembly. The pin assembly includes the housing 64, the weight block 65 that is slidable in the housing 64, and the pin 63. The pin 63 is provided with the first hinging hole 632 and the second hinging hole 633. The second hinging hole 633 has an elongated structure with two curved ends. The pin 63 is hinged on the housing 64 through first hinging hole 632 and is hinged to the weight block 65 through the second hinging hole 633. The pin 63 is provided with the inserting part 631 that extends beyond the housing 64. When the weight block 65 moves downward to the lowest position, the inserting part 631 of the pin 63 passes through the aligned locating holes 211 and 221 such that the upper bracket 21 and the lower bracket 22 are fixed relative to each other. One end of the pull-rod 62 is connected to the controlling switch 61, which is mounted on the upper bracket 21 and can be lifted by an external force. The other end of the pull-rod 62 is connected to the weight block 65, which is connected to the pin 63. When the controlling switch 61 is activated, the pull-rod 62 is pulled to move the weight block 63 upward such that the pin 63 rotates about the first hinging hole 632 clockwise to retreat the inserting part 631 from the aligned locating holes 211 and 221. The spring 66 is provided between the weight block 65 and the housing 64 to bias against the weight block 65. When the controlling switch 61 is released or deactivated, the weight block 65 slides downward under the gravity and the biasing force of the spring 66 such that the pin 63 can rotate about the first hinging hole 632 counter-clockwise to insert the inserting part 631 into the aligned locating holes 211 and 221.

Figure 4:
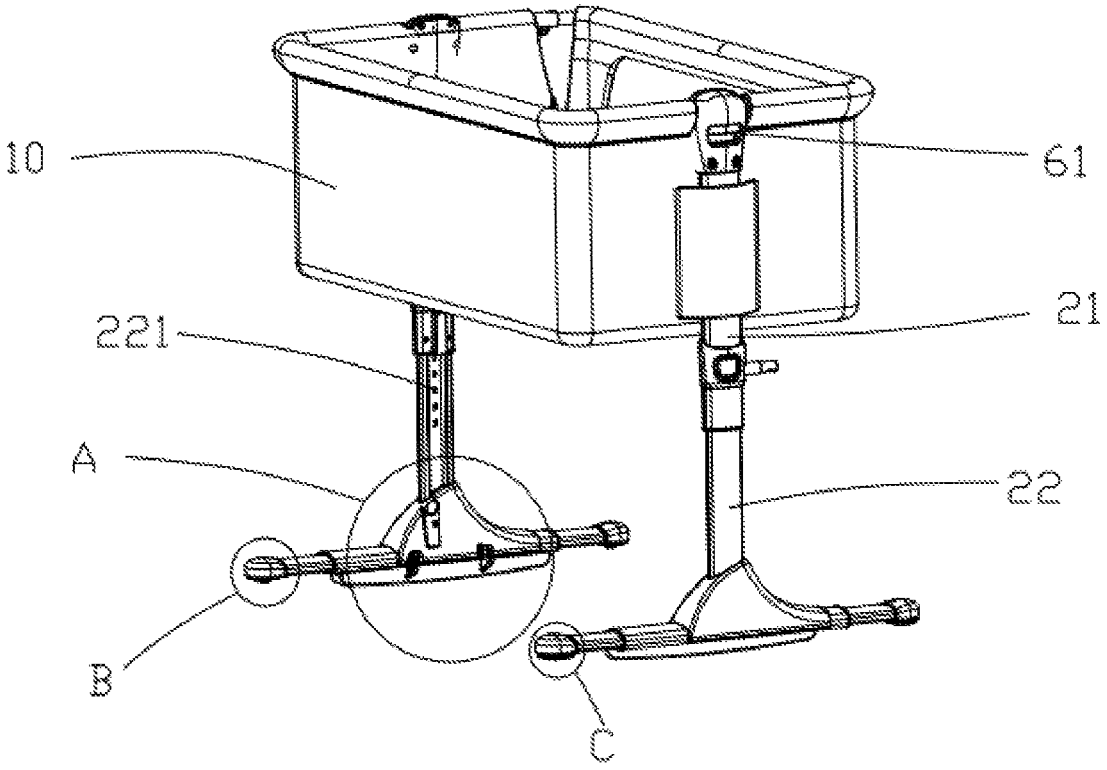
FIG. 4 is another schematic view of the crib according to the present invention where the foldable plate is unfolded.
Figure 5:
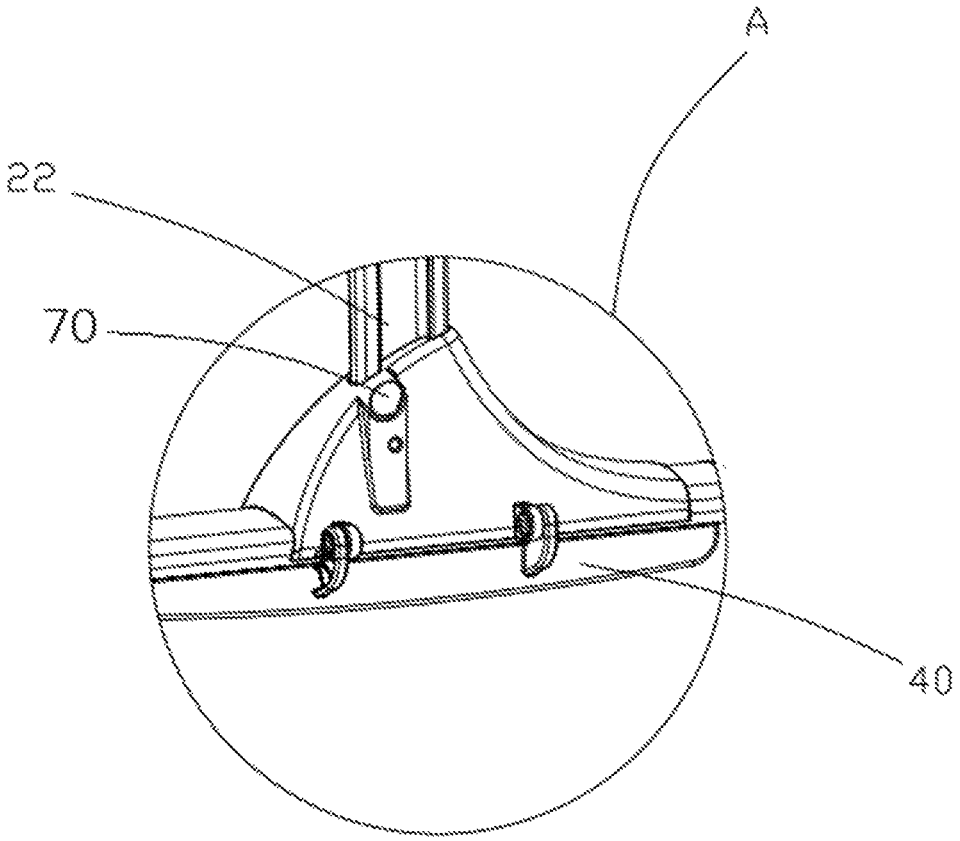
FIG. 5 is an enlarged view of part A in FIG. 4.
Figure 6:
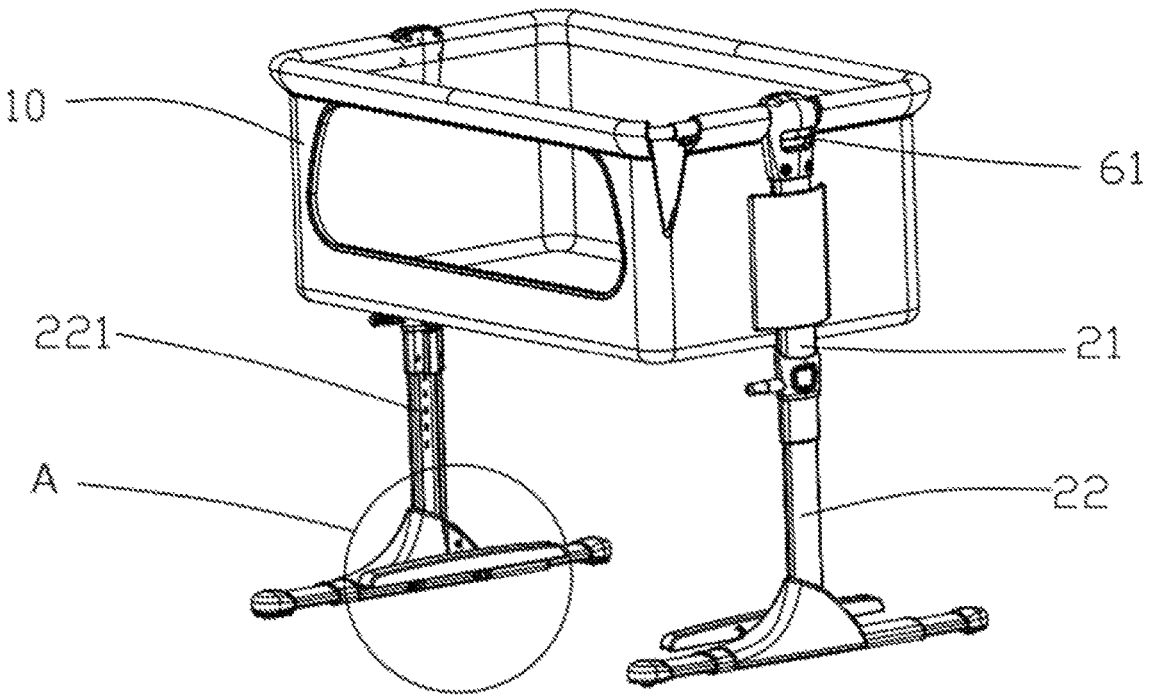
FIG. 6 is another schematic view of the crib according to the present invention where the foldable plate is folded.
Figure 7:
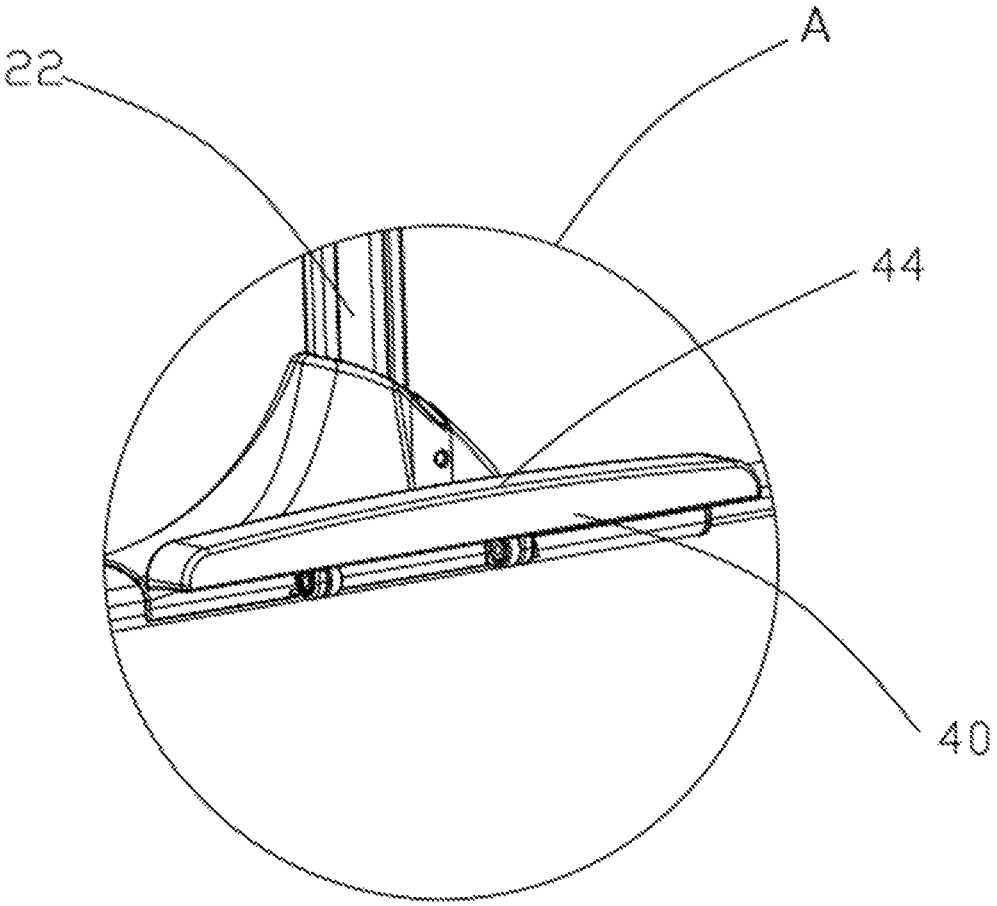
FIG. 7 is an enlarged view of part A in FIG. 6.

FIG. 4 is another schematic view of the crib according to the present invention, where the foldable plate is unfolded. FIG. 5 is an enlarged view of the unfolded foldable plate. FIG. 6 is another schematic view of the crib according to the present invention where the foldable plate is folded. FIG. 7 is an enlarged view of the folded foldable plate. As shown in FIG. 4 through FIG. 7, the foldable plate 40 is pivotably connected to a horizontal bar of each inversed T-shape bracket 22 and can be rotated between a folded position and an unfolded position.

Figure 8:
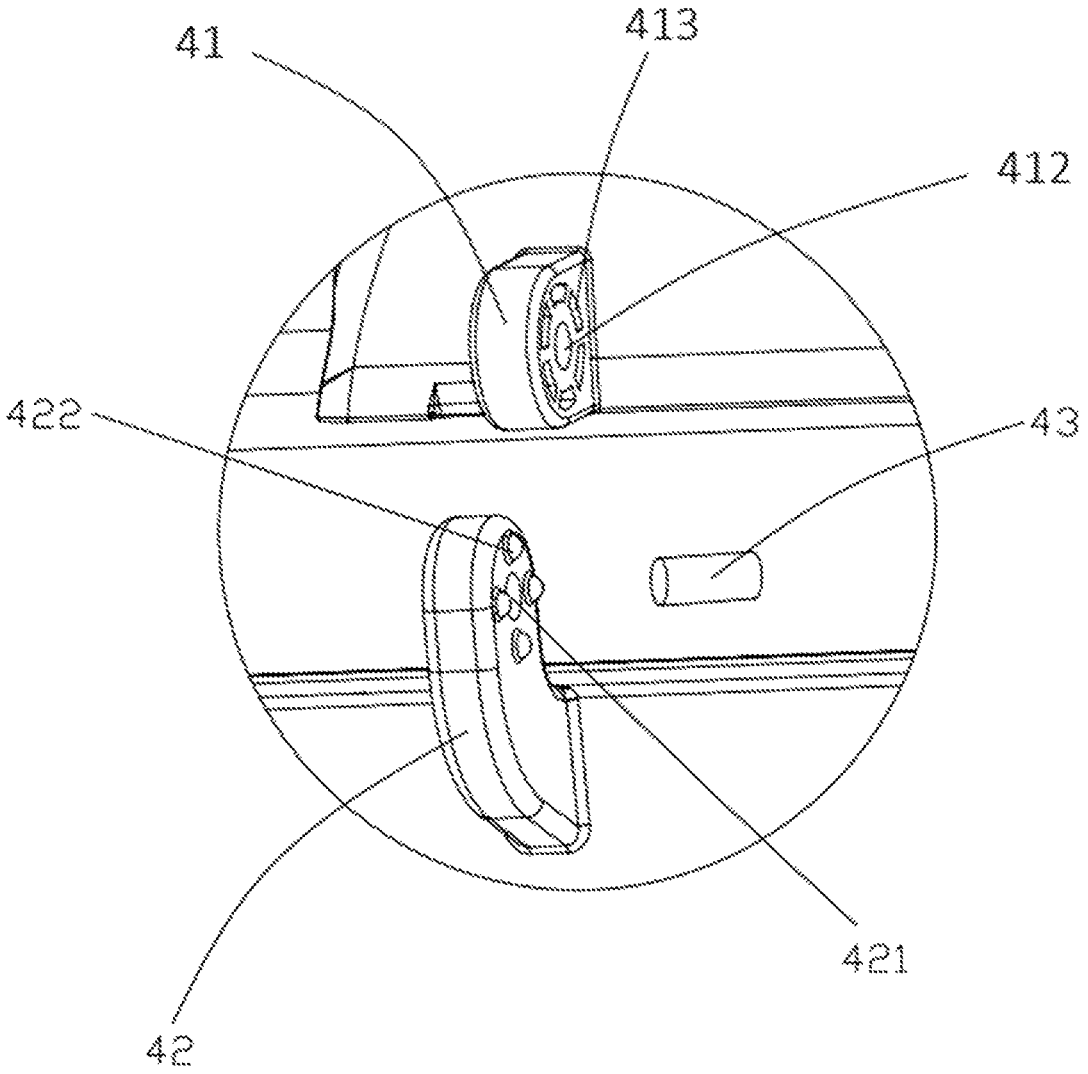
FIG. 8 is a schematic view of the installation of a foldable plate.

FIG. 8 is a schematic view of the installation of a foldable plate. As shown in FIG. 4 through FIG. 8, the inner side of each lower section 22 is provided with two first mounting bases 41 each protruding from the side surface of the lower section 22. Each first mounting base is provided with the shaft hole 412 and six locating holes 413 surrounding the first shaft hole 412 evenly. Each foldable plate 40 is provided with two second mounting base 42 each cooperating with one first mounting base 41. Each second mounting base 42 is provided with the second shaft hole 421 and four locating posts 422 surrounding the second shaft hole 422 evenly. Each locating bump 422 has a semispherical structure and can be fitted into one of the locating holes 413. Each pair of the first mounting base 41 and the second mounting base 42 are pivotably connected to each other through the rotation shaft 43 passing through the first shaft hole 412 and the second shaft hole 413 with the locating bumps 422 received in corresponding locating holes 413. Those skilled in the art should know, the number of locating holes 413 and the number of locating bumps 422 can be adjusted as needed. When the foldable plate 40 is folded, the locating bumps 422 can be received in different locating holes 413 to provide different intermediate positions with different inclination degrees between the completely unfolded position and completely folded position of the foldable plate 40. When the foldable plate 40 is in its unfolded position, the curved surface contacts the ground to support the whole crib, and the wheels, which will be described hereafter, will be in hanging position and will not touch the ground. In this position, the crib can function as a cradle. When the foldable plate 40 is in its folded position, the wheels will contact the ground to support the whole crib. In this position, the crib can function as a stable bed. The radius of the curved surface of the foldable plate 40 can be designed as per requirement. In some embodiments, both sides of each lower section 22 are provided with the foldable plate 40 to provide stability when the foldable plate 40 is in its intermediate position to provide the swing effect. In some embodiments, the wheel can be received in the lower section 22 or is rotatable to keep in the air when the foldable plate 40 is fully unfolded. In some embodiments, the foldable plate 40 is designed such that when fully unfolded, both the curved surface 44 and the wheels contact the ground. In this situation, the user can switch the crib between the cradle-type and the stationary-type by simply unfolding the foldable plate 40 and suspending the wheels. Consequently, the requirement of lifting the crib before unfolding the foldable plate is eliminated.

Figure 9:
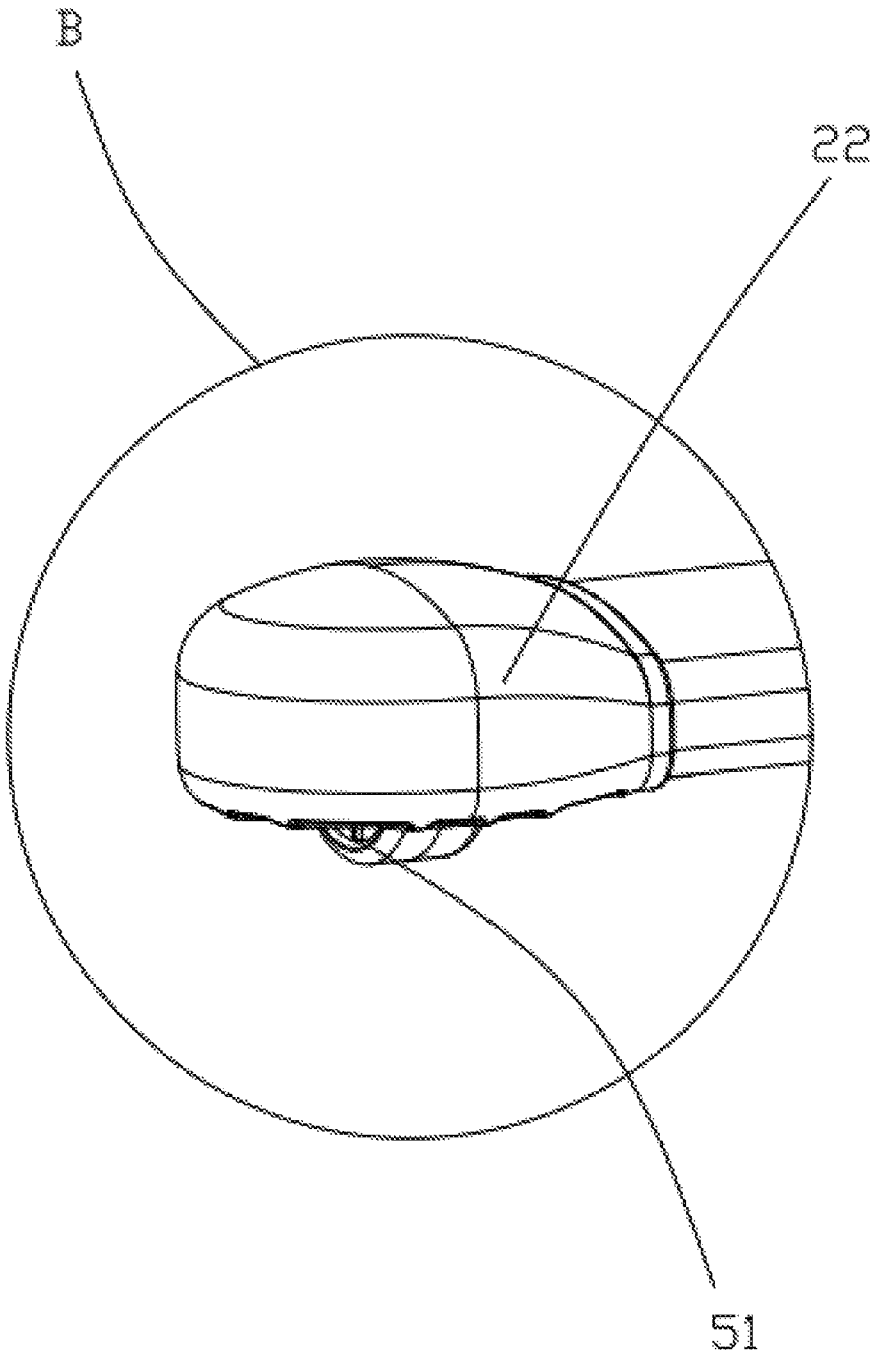
FIG. 9 is an enlarged view of part B in FIG. 4.

FIG. 9 is an enlarged view of part B in FIG. 4. As shown in FIG. 9, each end of the horizontal bar of the lower section 22 is provided with the wheel 51.

Figure 10:
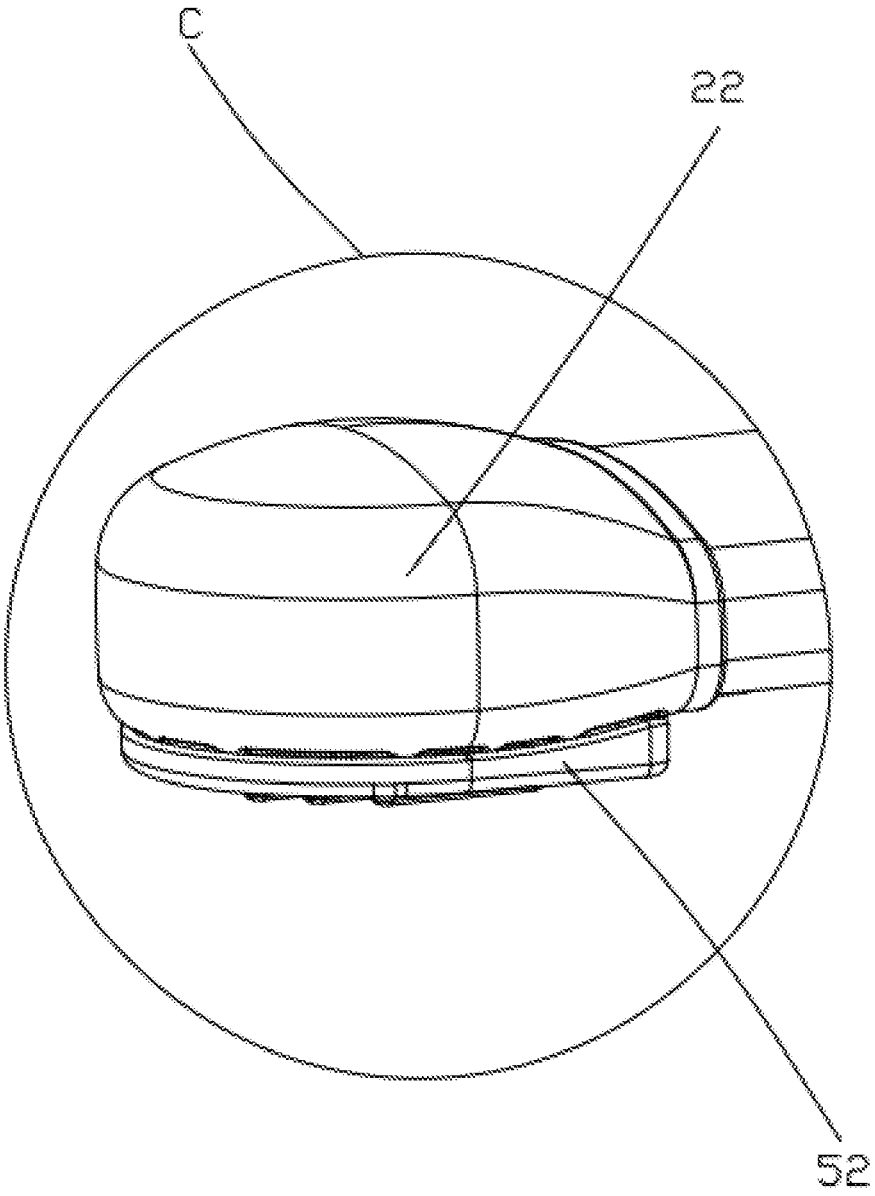
FIG. 10 is an enlarged view of part C in FIG. 4.

FIG. 10 is an enlarged view of part C in FIG. 4. As shown in FIG. 9, each wheel 51 is provided with the stopping element 52 to prevent the wheel 52 from rolling. In some embodiments, only one lower section 22 is provided with wheels 51, and the stopping element 52 is provided on the other lower section 22.

The crib of the present invention can realize the switch between the cradle-type and the stationary-type and is characterized in high practicability and lower space occupancy.

Figure 11:
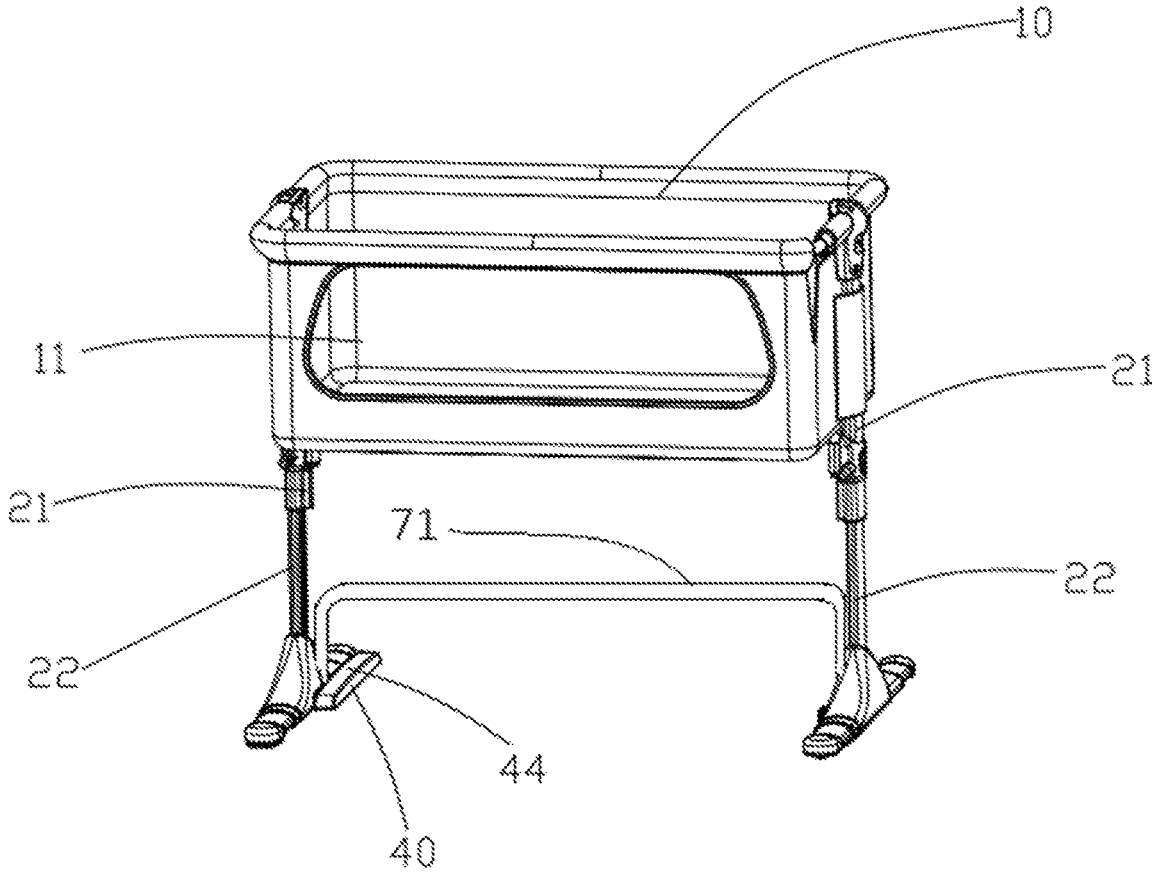
FIG. 11 is schematic view of the crib according to the present invention wherein the reinforcement bar is shown.

FIG. 11 is schematic view of the crib according to the present invention where a reinforcement bar is shown. As shown in FIG. 11, the crib further comprises a reinforcing bar 71 which is connected between the two lower sections 22 to reinforce the crib. The reinforcing bar 71 has a C-shaped structure. Each end of the reinforcing bar is vertically received in a receiving hole 70 provided on the lower section.

Figure 12:
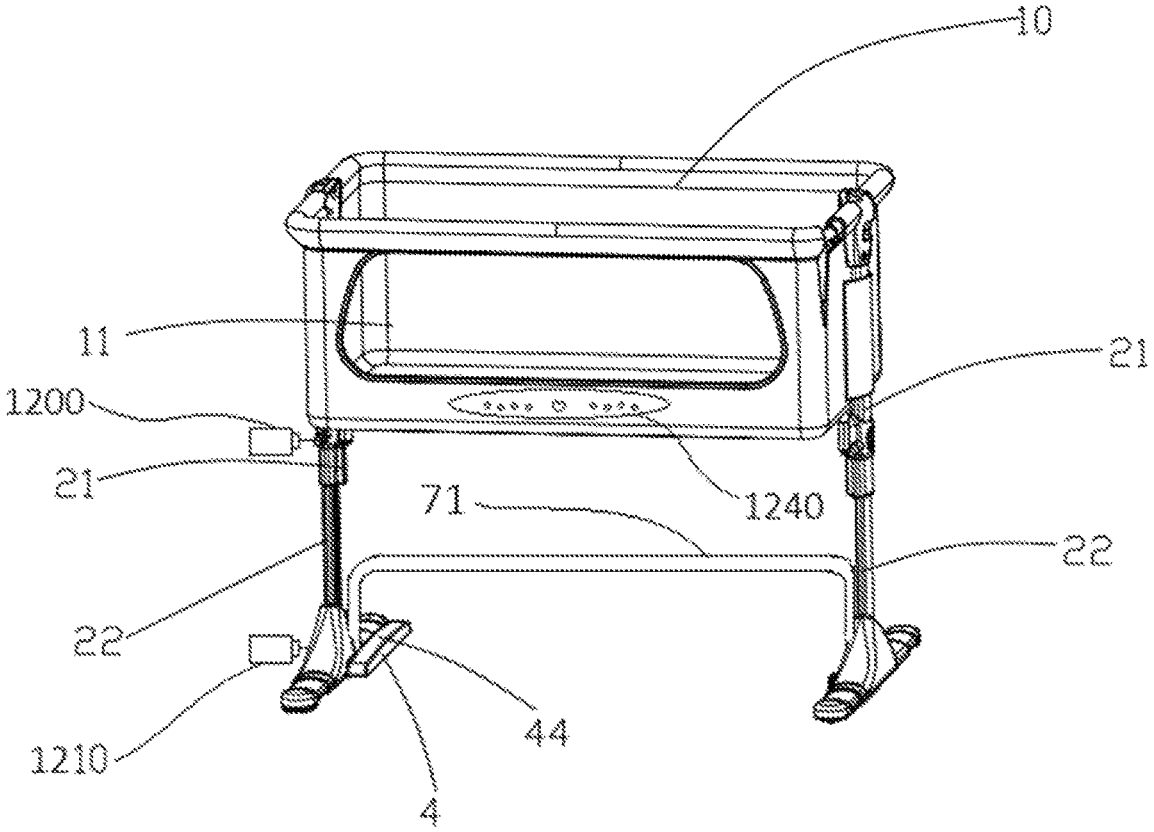
FIG. 12 is schematic view of the crib according to the present invention showing motors and control panel.
Figure 13:
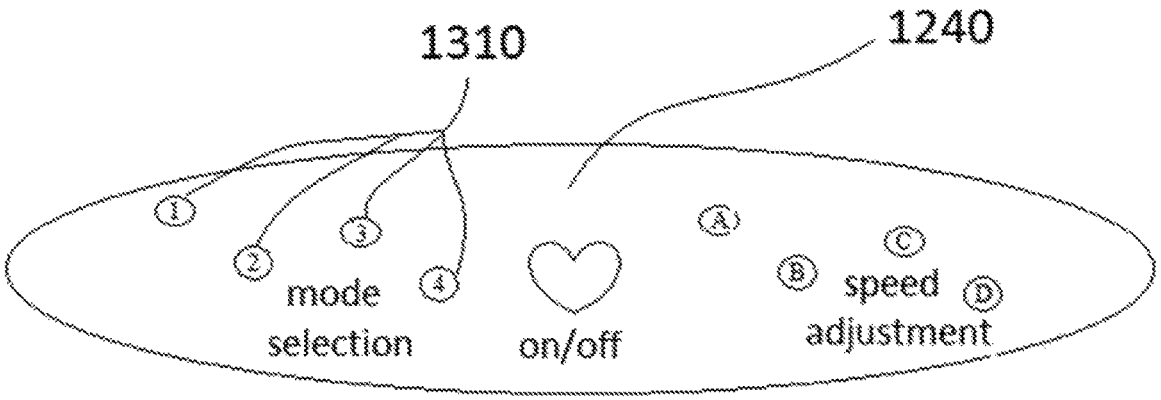
FIG. 13 is enlarged view of the control panel.

Further, referring to FIG. 12, in some embodiments, a motor 1200 is provided on the lower section to drive the folding and unfolding of the foldable plate 40. A switch is provided on the crib to control the operation of the motor to fold and unfold the foldable plate. Another motor 1210 may be provided to control the deployment of the wheels 51. Both motors 1200 and 1210 can be controlled remotely and wirelessly. The controlling can be achieved by a specific App installed on the user's cellphone or other devices. In another embodiment, a single motor can control both the operations of folding and unfolding of the foldable plate, and deployment of the wheels. The single motor can be operated in multiple modes to perform folding and unfolding of foldable plate 40, deployment of wheels 51, to move the crib when the wheels are deployed, to swing the crib etc. as per user control. The different modes of operation can be controlled through a control panel 1240 provided on the crib or can be remotely controlled through a wireless device or an App installed on a smartphone. The user can also control the speed of movement or speed of swinging operation. The control panel 1240 can be a simple microcontroller or microprocessor based control unit. Further referring to FIG. 13, the control panel 1240 can have mode selection switch 1310, speed adjustment control. The control panel 1240 can be a touch screen panel where different mode of operations can be selected through touch panel. In another embodiment a camera is installed on the crib to monitor the baby remotely.

Although the present invention has been described with reference to the preferred embodiments, it is apparent to those skilled in the art that a variety of modification and changes may be made without departing from the scope of the patent for an invention which is intended to be defined by the appended claims.

I claim:

1. A crib, comprising:

an enclosing element configured for holding a baby therein;

a frame assembly configured for supporting the enclosing element;

a bracket assembly connected to the frame assembly and configured for supporting the frame assembly; and at least two foldable plates pivotably connected to the bracket assembly such that each foldable plate can rotate between an unfolded position and a folded position, wherein each foldable plate has a curved surface, the curved surfaces of the at least two foldable plates contact ground to enable the crib to swing when the at least two foldable plates are in their unfolded position; and wherein the bracket assembly includes a first bracket and a second bracket, each of the first bracket and the second bracket includes an upper section and a lower section telescopically connected to the upper section, the lower section has an inverted T-shaped structure and includes an upright bar and a horizontal bar, the at least two foldable plates are pivotably connected to the horizontal bars.

2. The crib according to claim 1, wherein each horizontal bar includes two first mounting bases, and each foldable plate includes two second mounting bases each corresponding to one of the first mounting bases, each first mounting base has a first shaft hole, each second mounting base has a second shaft hole.

3. The crib according to claim 2, wherein the foldable plate is pivotably connected to the horizontal bar through one shaft passing through the two first shaft holes and the two second shaft holes or through two shafts each passing through one pair of the first shaft hole and the second shaft hole.

4. The crib according to claim 3, wherein each first mounting base has a plurality of locating holes disposed in a first circle with the first shaft hole as the center of the first circle, each second mounting base has a plurality of locating bump disposed in a second circle with the second shaft hole as the center of the second circle, each locating bump is adapted to be received in each locating hole such that multiple intermediate positions can be provided between the unfolded position and the folded position; and wherein the number of the plurality of locating holes is no less than the number of the plurality of locating bumps.

5. The crib according to claim 4, wherein the number of the plurality of locating bumps are four, and the number of the plurality of locating holes are six.

6. The crib according to claim 5, wherein the enclosing element includes four side walls and a bottom portion, at least one of the side wall is provided with an opening for observing the baby.

7. The crib according to claim 6, wherein the frame assembly includes an upper frame for supporting top edges of the side walls of the enclosing element and a lower frame for supporting the bottom of the enclosing element.

8. The crib according to claim 7, wherein both the upper frame and the lower frame are connected to the upper section of the bracket assembly.

9. The crib according to claim 8, wherein each the upper section and the lower section of the bracket assembly is provided with one or more locking holes through which the upper section and the lower section can be fixed relative to each other.

10. The crib according to claim 9, further comprising: a pull-rod controlling mechanism, wherein the pull-rod controlling mechanism includes a. controlling switch attached to the upper section of the bracket assembly, a pin assembly disposed on the bracket assembly, and a pull-rod connected between the controlling switch and the pin assembly.

11. The crib according to claim 10, wherein the pin assembly includes a housing, a weight block slidable in the housing, a pin having an inserting part extending beyond the housing, and a spring is provided between the weight block and the housing to provide a biasing force against the weight block, and wherein the pin is provided with a first hinging hole and a second hinging hole, the second hinging hole has an elongate structure with two curved ends, the pin is hinged to the housing through first hinging hole and is hinged to the weight block through the second hinging hole such that when the weight block moves downward under the gravity and the biasing force, the pin rotates about the first hinging hole counterclockwise to insert the inserting part into two aligned locking holes the upper bracket and the lower bracket to lock the upper bracket and the lower bracket with each other.

12. The crib according to claim 11, wherein each end of each horizontal bar is provided with a wheel.

13. The crib according to claim 12, wherein the foldable plate is shaped and sized such that when the foldable plate is fully unfolded, all the wheels and the curved surfaces contact the ground.

14. A crib frame, comprising: a frame assembly;

a bracket assembly connected to the frame assembly and configured for supporting the frame assembly; and at least two foldable plates pivotably connected to the bracket assembly such that each foldable plate can rotate between an unfolded position and a folded position, wherein each foldable plate has a curved surface, the curved surfaces of the at least two foldable plates contact ground to enable the crib to swing when the at least two foldable plates are in their unfolded position; and wherein the bracket assembly includes a first bracket and a second bracket, each of the first bracket and the second bracket includes an upper section and a lower section telescopically connected to the upper section, the lower section has an inverted T-shaped structure and includes an upright bar and a horizontal bar, the at least two foldable plates are pivotably connected to the horizontal bars.

15. The crib frame according to claim 14, wherein each horizontal bar includes two first mounting bases, and each foldable plate includes two second mounting bases each corresponding to one of the first mounting bases, each first mounting base has a first shaft hole, each second mounting base has a second shaft hole.

16. The crib frame according to claim 15, wherein the foldable plate is pivotably connected to the horizontal bar through one shaft passing through the two first shaft holes and the two second shaft holes or through two shafts each passing through one pair of the first shaft hole and the second shaft hole.

17. The crib frame according to claim 16, wherein each first mounting base has a plurality of locating holes disposed in a first circle with the first shaft hole as the center of the first circle, each second mounting base has a plurality of locating bump disposed in a second circle with the second shaft hole as the center of the second circle, each locating bump is adapted to be received in each locating hole such that multiple intermediate positions can be provided between the unfolded position and the folded position; and wherein the number of the plurality of locating holes is no less than the number of the plurality of locating bumps.

18. The crib frame according to claim 17, wherein the number of the plurality of locating bumps are four, and the number of the plurality of locating holes are six.

* * * * *